United States Patent [19]

Amoroso

[11] 3,969,961

[45] July 20, 1976

[54] TORQUE LIMITING ADAPTOR

[75] Inventor: Michael J. Amoroso, Marion, Ill.

[73] Assignee: M.A.T. Industries, Inc., West Frankfort, Ill.

[22] Filed: Dec. 9, 1974

[21] Appl. No.: 530,935

[52] U.S. Cl. ..... 81/52.4 R
[51] Int. Cl.[2] ..... B25D 23/142
[58] Field of Search ..... 81/52.4 R, 52.5, 52.4 A; 64/30 R, 30 C, 30 A, 1 V

[56] References Cited

UNITED STATES PATENTS

| | | | |
|---|---|---|---|
| 1,433,590 | 10/1922 | Ziegler | 81/52.4 R X |
| 1,463,497 | 7/1923 | Bugatti | 81/52.4 R |
| 2,606,431 | 8/1952 | Elgin | 81/52.4 R X |
| 3,012,456 | 12/1961 | Dracka | 81/52.4 R |
| 3,585,817 | 6/1971 | McCafferty | 81/52.4 A |
| 3,662,628 | 5/1972 | Schnepel | 81/52.4 A |
| 3,695,059 | 10/1972 | Laubach | 81/52.4 A |

*Primary Examiner*—James L. Jones, Jr.
*Attorney, Agent, or Firm*—Cohn, Powell & Hind

[57] ABSTRACT

An adaptor for applying a predetermined amount of torque to a bolt includes a housing having one end engageable with the bolt, and a shaft coaxially mounted within the housing and having an opposite end engageable by a wrench. The shaft and housing are clutch-connected by a spring-loaded friction disc assembly, which is carried by the shaft and adjusted to slip when the torque applied to the bolt reaches a predetermined value. A visual indicator is provided which measures wear of the friction discs. A thrust bearing is provided at the bolt end of the housing to minimize friction loss between the adaptor and the work.

5 Claims, 7 Drawing Figures

TORQUE LIMITING ADAPTOR

BACKGROUND OF THE INVENTION

This invention relates generally to a torque wrench adaptor and particularly to an adaptor for limiting torque applied to a mine roof bolt.

Roof bolting has proved an effective means of promoting safety in mine operations. It is generally believed that the effectiveness results from the fact that the bolts provide a means by which the various bedded planes are connected together to form a beam which prevents roof falls and that the sagging of the roof is prevented because the tension in each bolt tends to increase the friction between the layers thus minimizing horizontal pressures. Understandably it is of great importance that the correct torque be applied to the roof bolts, particularly in the case of conventional roof bolts which consist of an expansion shell, a tapered nut and a threaded bolt having a bearing plate mounted thereon. When such bolts are used the roof is predrilled to receive the shell and the bolt is generally torqued with a wrench operated by the drilling unit. If a roof bolt is not tightened sufficiently it cannot support the roof load. If it is over-tightened there is a possibility of damage to the material adjacent the expansion shell, or to the shell itself. The amount of torque applied by a hydraulic drill unit of the type commonly used is determined by a relief valve. Such valves are unreliable and, after the bolts are tightened, it is necessary to use a hand-operated torque wrench to test each bolt. Under-tightened bolts can be tightened, but those that have been over-tightened cannot be slackened off without the risk of damage to the roof.

Of course, torque wrenches in themselves are not new, and wrenches are known which utilize a clutch device to predetermine the point at which the wrench parts will slip. However, in general, the clutch drive connection of such wrenches is disposed between two parts of an interior drive shaft rather than between a drive shaft and an exterior housing, which results in a complicated structure. In addition, although torque wrenches are known which are capable of adjustment, the adjustment feature is invariably provided by relatively movable housing portions which are threadedly related to compress an internal spring against a clutch assembly. Such a structural arrangement of parts renders inadvertent adjustment likely.

The above disadvantages are avoided by the present device in a manner not disclosed in the known prior art.

SUMMARY OF THE INVENTION

The primary object of this invention is to provide a torque limiting adaptor for a roof bolt, the adaptor consisting essentially of a housing, a rotatable drive shaft mounted within the housing and a clutch connection between said shaft and said housing which slips at a predetermined torque, the adaptor having means at one end of the housing engageable with the bolt and means at the opposite end of the shaft engageable with a power wrench, whereby torque up to a predetermined value is applied from the wrench to the bolt through the medium of the adaptor.

An important object of this invention is to provide adjustment means mounted within the housing for adjusting the clutch to slip at a selected, predetermined torque value.

Another object is to provide an adaptor in which the drive shaft and housing rotate as a unit until such time as the predetermined torque is achieved at which time the housing ceases to rotate, thereby providing a visual indication that the bolt is sufficiently tightened.

It is an object to provide an adaptor in which the shaft and housing both cease to rotate if insufficient torque is applied to achieve the predetermined torque value thereby providing a visual indication that the bolt is insufficiently tightened.

An object is to provide an adaptor which can be used with a conventional hydraulic roof drill unit and which provides visual indication of when the relief valve setting of the drill unit is too low.

Still another object is to provide means mounting the shaft within the housing which include axially spaced radial bearings disposed between the shaft and the housing for journal mounting the shaft to the housing and a thrust bearing disposed between the shaft and the housing for transferring axial load from the shaft to the housing.

An important object is to provide clutch means between the shaft and the housing including a plurality of first and second friction discs keyed respectively to the shaft and the housing and operatively pressure-engageable to rotate the shaft and housing together when the torque applied to the bolt by the wrench, through the medium of adaptor is below a predetermined value.

Yet another important object is to provide clutch adjustment means carried by the shaft for selectively adjusting pressure engagement between the friction discs.

Still another object is to provide clutch means that includes axially spaced upper and lower index means which move relative to each other to reflect a change in the collective thickness of the friction discs, and to provide a reference point on the housing adjacent one of said index means to measure relative movement of said index means and thereby provide a visual indication of clutch disc wear.

Yet another object is to provide a thrust bearing assembly for transferring axial thrust from the housing to the bearing plate of the mine roof bolt, so that the housing does not directly engage said bearing plate and frictional losses between the housing and the bearing plate are thereby minimized.

An important object of this invention is to provide an adaptor which can readily be used in conjunction with a mine roof power drill unit and which is relatively inexpensive to manufacture, is extremely effective in operation and can easily be used by an operator with a minimum of instruction.

DESCRIPTION OF THE PREFERRED EMBODIMENT

Figure 1:
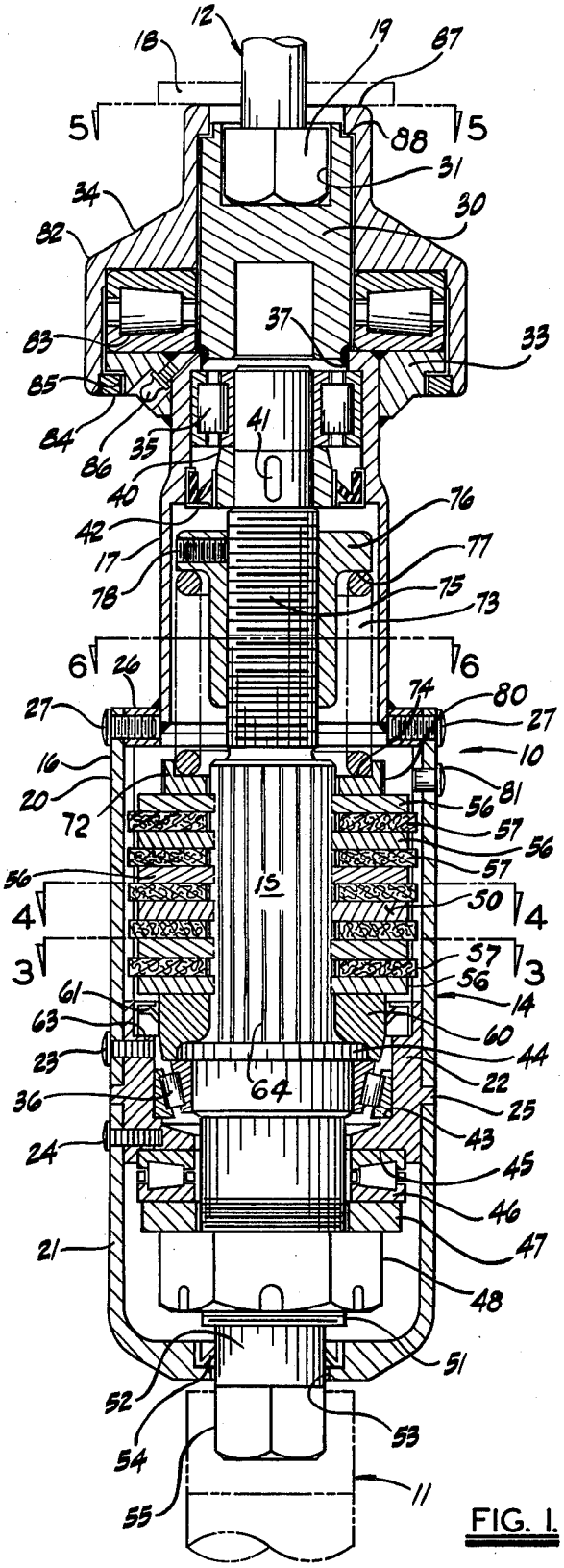
FIG. 1 is a vertical section through the adaptor taken along the longitudinal axis thereof.
Figure 2:
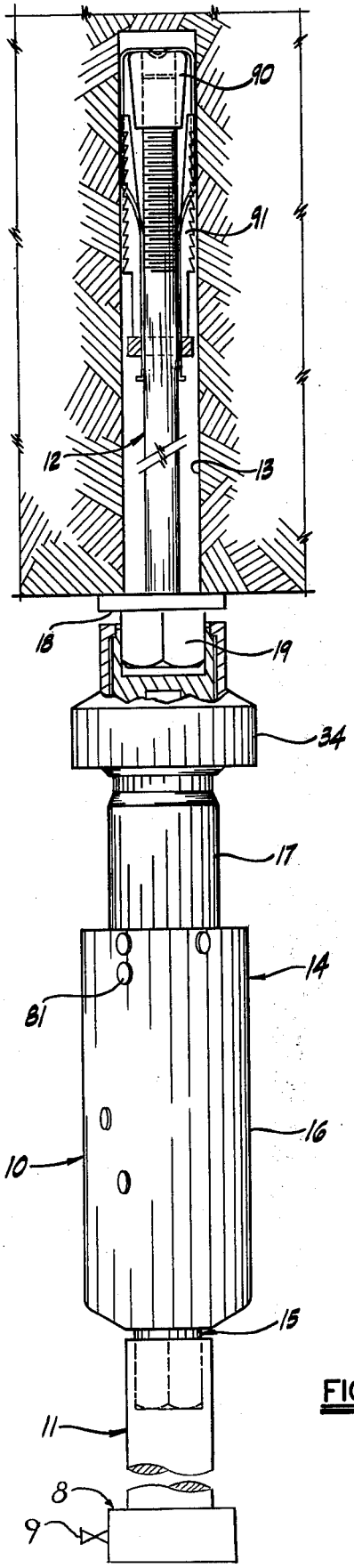
FIG. 2 is a partly fragmentary, elevational view illustrating the adaptor, as used to apply torque to a mine roof bolt, and showing the roof drill unit schematically.

Referring now by characters of reference to the drawings and first to FIGS. 1 and 2 it will be understood that the adaptor, which is generally indicated by numeral 10, is employed in conjunction with a hydraulic wrench 11 such as provided by the chuck of a conventional roof drill unit 8 having a relief valve 9 as schematically shown in FIG. 2. This unit 8 is of the type commonly used to apply torque to a conventional mine roof bolt 12 to tighten the bolt assembly within a predrilled hole 13 with a view to reinforcing the mine roof. The adaptor 10, which is connected between the wrench 11 and the bolt 12 and is provided with suitable engagement means at each end to facilitate this connection, ensures that the bolt 12 will not be tightened beyond a predetermined torque.

As shown specifically in FIG. 1, the adaptor 10 includes an elongate housing 14, having a shaft 15 journal mounted therewithin, and including lower and upper portions 16 and 17 respectively. The housing lower portion 16 is of uniform outside diameter and consists of two sections 20 and 21, which are connected together by means of a connector ring 22. Each of said sections 20 and 21 are attached to the ring 22, as by fasteners 23 and 24, and said ring includes an outstanding annular rib 25 to facilitate such attachment. The housing upper portion 17, is of reduced diameter and includes an integral flange 26 to which the housing lower portion 16 is attached as by fasteners 27. The housing upper portion 17 is provided with an integral cap 30 having a socket 31 which is configurated to receive the square head 19 of the bolt 12 and said upper portion 17 also includes an integral flane 33 which constitutes an abutment means and provides a seat for an upper thrust bearing assembly 34, which will be described later.

The shaft 15 is mounted within the housing 14 by means of an upper radial bearing 35 and a lower radial bearing 36 said bearings constituting spaced journal bearing means. The radial bearing 35 is axially retained between an annular lip 37, provided on the housing upper portion 17 and a retaining collar 40, which is fixedly attached to the shaft 15 by means of a key 41. An annular seal 42 is provided between the collar 40 and the interior face of the housing. The lower radial bearing 36 is engageable with an inner annular shoulder 43 provided on the connector ring 22 and said radial bearing provides a seat for the shaft 15 which includes a seating flange 44 for this purpose.

Axial thrust is transferred from the shaft 15 to the housing 14 by a lower thrust bearing 46 which constitutes a first thrust bearing means. The housing connector ring 22 includes an annular recess 45, receiving said bearing 46, said ring constituting an interior abutment means. The lower thrust bearing 46 is carried on the shaft 15 and retained on said shaft by means of a bearing washer 47 and a lock nut 48, which constitute an exterior shoulder means and are mounted on a threaded shaft portion 51. The thrust bearing 46, being disposed between ring 22 and washer 47, effectively transfers axial thrust from the shaft 15 to the housing 14.

The shaft 15 includes a lower end portion 52 which projects outwardly through an aperture 53 provided at the lower end of the housing 14 and socketed to receive a seal 54 disposed between the shaft and the housing. The extreme lower end of the shaft 15 is formed into a square end 55 corresponding in size to the mine roof bolt head 19 normally received by the power wrench 11. The power wrench 11 is adapted to receive said bolt head and therefore receives the shaft end 55.

Figure 4:
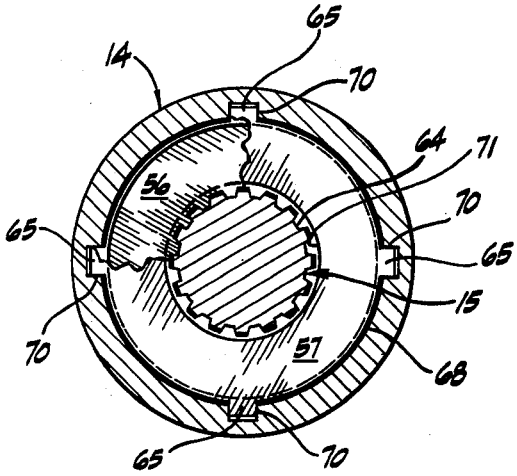
FIG. 4 is a similar cross-sectional view taken on line 4—4 of FIG. 1.
Figure 3:
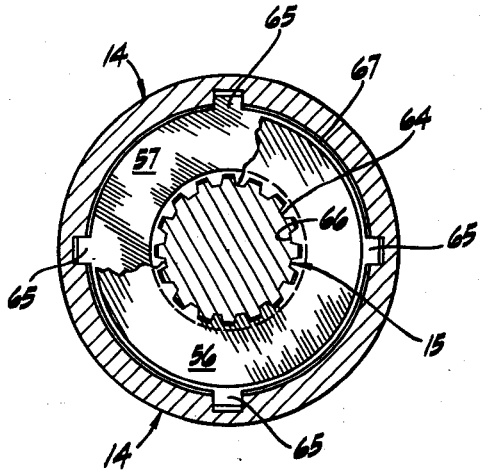
FIG. 3 is a cross-sectional view taken on line 3—3 of FIG. 1 illustrating the friction disc assembly.

Importantly, the shaft 15 carries a clutch assembly, which constitutes a pressure engageable drive means between the housing 14 and the shaft 15 and is generally indicated by numeral 50. The clutch assembly 50 includes a plurality of alternately disposed first and second friction discs 56 and 57, preferably of metal and fabric respectively, and the lowermost disc 56 is seated on a bearing washer 60 which is itself disposed in seated relation above the retaining flange 44 of the shaft 15, said washer and flange constituting a seating means for said disc assembly. The washer 60 is sealed from the housing by means of an annular seal 61, and the connector ring 22 includes an annular recess 63 adapted to receive said seal. As clearly shown in FIGS. 3 and 4 the shaft 15 includes a keyed or splined portion 64, and the inner surface of the housing includes a plurality of longitudinal keyways 65. As shown particularly in FIG. 3 the metal friction discs 56 include an inner margin 66, compatibly configurated to engage the shaft splined portion 64, and an outer margin 67 of sufficiently small diameter to be clear of the inner wall of the housing 14. As shown particularly in FIG. 4, the fabric friction discs 57 are provided with an outer margin 68 formed into projecting portions 70, compatibly configurated to engage the keyways 65, and an inner margin 71 of sufficiently large diameter to be clear of the splined portion of the shaft 15.

A bearing collar 72 is disposed above the uppermost friction disc 56 and provides a seat for a resilient means in the form of a compression spring 73, said collar being socketed at 74 to seat said spring. The shaft 15 includes a threaded portion 75 above the splined portion 64. A threaded element 76 having a flange 77 is disposed in movable relation on said threaded portion and said flange 77 is engageable with the upper end of said spring 73. The flanged element 76 is adjustably located and locked in place by means of a set screw 78 and provides a means of adjusting the pressure between the friction discs 56 and 57. The pressure adjustment means is thereby carried by the shaft 15.

Figure 7:
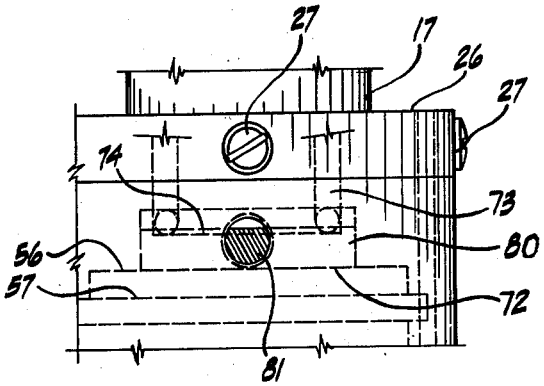
FIG. 7 is a fragmentary elevational view illustrating the wear indicator.
Figure 6:
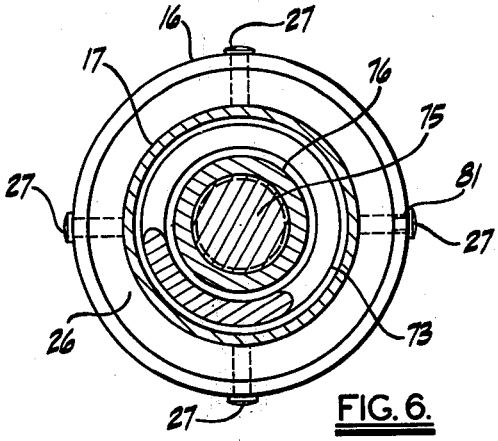
FIG. 6 is a cross-sectional view taken on line 6—6 of FIG. 1 illustrating the clutch adjustment assembly.
Figure 5:
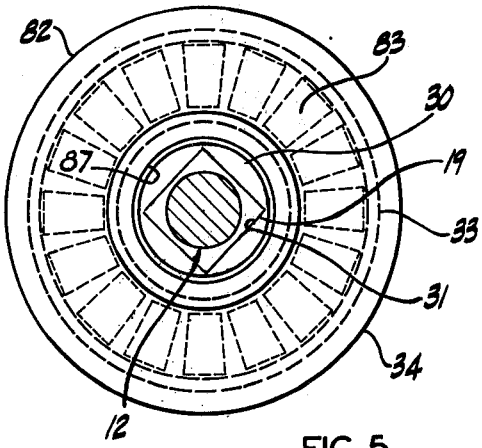
FIG. 5 is a plan view taken on line 5—5 of FIG. 1 illustrating the upper thrust bearing assembly.

Importantly, as shown in FIG. 7, the bearing collar 72 is provided with a distinctive color band 80 on its outer periphery and the housing section 20 is provided with a transparent window 81 by which the location of the color band 80 may be observed. The position of the lowermost disc 56 is disposed in fixed relation to the longitudinal axis of the housing 14 because the shaft retaining flange 44 and bearing collar 60 seated upon said flange, are fixed longitudinally relative to said housing. The uppermost disc 56, and therefore the collar 72 bearing the color band 80, are movable toward said bearing collar 60 as the collective thickness of the discs decreases as the result of wear. Said uppermost disc 56 and the collar 72 are therefore movable in the direction of the longitudinal axis of the housing 14. Thus, the bearing collar 60 and the color band 80 at opposite ends of the clutch disc assembly constitute axially spaced index means providing an indication of the collective thickness of the discs while the housing window 81 provides a reference point fixed relative to the bearing collar 60 and providing a datum for movement of the color band 80 whereby to measure disc wear.

The upper thrust bearing assembly 34 provides a means of transferring thrust from the housing 14 to the mine roof bolt assembly bearing plate 18, and therefore to the work i.e. the mine roof, without substantial loss of torque from friction between the end of said housing and said plate. Essentially, the thrust bearing assembly 34 provides a housing 82 for a thrust bearing 83 which is seated on the abutment flange 33. The bearing housing 82 includes a retaining ring 84, which is accommodated within an annular access 85 formed on the underside of the abutment flange 33, said ring 84 being tack welded, or otherwise attached to the housing 82. A grease nipple 86 is provided in abutment flange 33 to lubricate the thrust bearing. At its upper end the bearing housing 82 projects beyond the adaptor housing cap 30 and includes an annular bearing lip 87, which is accommodated within a compatibly formed recess 88 at the upper end of the cap 30. The thrust bearing assembly 34 is thereby substantially permanently mounted to the upper end of the adaptor and provides a means of spacing the adaptor housing from the bearing plate 18. Frictional engagement between the end of the adaptor cap 30 and said plate 18, which would otherwise be present when the housing commenced to rotate is thereby avoided because said cap 30 and said upper thrust bearing assembly 34 are freely rotatable relative to each other.

It is thought that the functional advantages of this torque limiting adaptor have become fully apparent from the foregoing description of parts but for completeness of disclosure the operation of the adaptor will be briefly described.

Following the drilling of the hole 13 in the mine roof the bolt 12, with the bearing plate 18 installed, is inserted into said hole 13. The nature of the conventional bolt assembly shown in FIG. 2 is such that rotation of the bolt 12 draws down the tapered nut 90 and thereby expands the shell 91 against the side of said hole. Torque is applied to the bolt head 19 indirectly by the wrench 11, operating through the medium of the adaptor 10 by engaging the head configuration 55 formed at the lower end of the shaft 15. Because of the clutch connection between the adaptor housing 14 and the shaft 15 these two elements rotate as a unit until such time as the applied torque exceeds the torsional frictional resistance between the clutch discs 56 and 57. This resistance is a function of the pressure applied to the discs by the compression spring 75 and can be selectively predetermined.

The structural arrangement of the housing parts permits the shaft 15 to be readily removed from the housing 14 by simply removing fasteners 27 which connect the upper and lower housing portions 16 ad 17 together. The frictional resistance of the clutch assembly is increased by rotating the movable element 76 on the threaded portion of the shaft 75, which shortens the length of the compression spring 73 thereby increasing the pressure between said discs. If desired the housing lower portion 21 can be removed to permit the adjustment to be made while the shaft 15 remains in place within the housing upper portion 20.

The housing 14 and shaft 15 rotate as a unit until the predetermined resistance is exceeded at which time the housing 14 remains stationary while the drive shaft 15 continues to rotate as a result of slippage between the clutch discs 56 and 57. Thus, when the housing 14 is stationary and the shaft 15 continues to rotate a visual indication is provided for the operator, which clearly indicates to him that the predetermined torque has been delivered to the bolt 12.

The conventional hydraulic roof drill unit 8, or roof bolter as they are sometimes called, can readily be utilized to provide the power necessary to apply torque to the adaptor shaft 15. When such unit 8 is employed the chuck power output means provides the wrench 11. Conventional hydraulic drill units 8 are commonly used to torque mine roof bolts directly, and as already discussed, suffer from the disadvantage that the setting of the relief valve 9, by which the output torque is controlled, can be maladjusted with serious consequences.

It will be apparent that when such a drill unit 8 is used in conjunction with the adaptor 10 bolt, overtightening is avoided. In addition, bolt undertightening, resulting from a low setting of the relief valve 9 is also avoided. The reason for this is that the shaft and housing rotate as a unit until slippage occurs, and both will become stationary if insufficient torque is being applied by the drill unit through the medium of the adaptor 10 to torque the bolt 12 to the predetermined value. The shaft 15 is operatively connected to the chuck and therefore the mutual rotation of these parts relative to the housing is plainly visible. Thus, when the housing 14 and the shaft 15 both cease to rotate, such cessation will provide a visual indication to the operator that the drill unit is delivering insufficient torque and the relief valve 9 must be reset.

The torque resistance of the clutch assembly can be determined by means of a conventional torque wrench and the adaptor can be calibrated if desired by reference to the location of the movable element 76 on the shaft 15. After a period of use, the wear on the discs results in an overall reduction of their thickness. Because the collar 72 is provided with a color band 80 the extent of this wear can be gauged by observing the relative position of said color band through the window 81 which provides a fixed reference point. Thus, a convenient visual indication of clutch wear is readily available without the need to disassemble the adaptor. In the preferred embodiment, when the color band is no longer visible the adaptor must be recalibrated or the discs must be replaced.

I claim as my invention:

1. An adaptor for limiting torque applied to a bolt by a wrench, the adaptor comprising:

a. a housing including engagement means at one end and an exterior abutment means, b. an elongate shaft disposed coaxially within the housing and including engagement means at the end remote from said housing engagement means, one of said engagement means engaging the bolt and the other of said engagement means engaging the wrench, and c. means mounting the shaft within the housing including:

1. journal bearing means between the shaft and the housing for relative rotation of said shaft and housing,

2. thrust bearing means between the shaft and the housing for transferring axial load from the shaft to the housing, and

3. clutch means between the shaft and the housing including first friction disc means keyed to the shaft and second friction disc means keyed to the housing, said first and second disc means being operatively pressure engageable to rotate the shaft and housing together when the torque applied to the bolt by the wrench, through the medium of the adaptor, is below a predetermined value, 4. said clutch means including pressure adjustment means carried by the shaft for selectively increasing the engagement pressure between the first and second friction disc means to predetermine the slippage point between said disc means, and d. a second thrust bearing means seated on said abutment means and projecting axially beyond the housing end to transfer thrust to the mine roof by said projecting portion rather than by the relatively rotating housing engagement means.

2. An adaptor for limiting torque applied to a bolt by a wrench, the adaptor comprising:

a. a housing including engagement means at one end, b. an elongate shaft disposed coaxially within the housing said shaft including a threaded portion and including engagement means at the end remote from said housing engagement means, one of said engagement means operatively engaging the bolt and the other of said engagement means engaging the wrench, and c. means mounting the shaft within the housing including:

1. journal bearing means between the shaft and the housing for relative rotation of said shaft and housing, 2. thrust bearing means between the shaft and the housing for transferring axial load from the shaft to the housing, and 3. clutch means between the shaft and the housing including first friction disc means keyed to the shaft and second friction disc means keyed to the housing, said first and second disc means being operatively pressure engageable to rotate the shaft and housing together when the torque applied to the bolt by the wrench, through the medium of the adaptor, is below a predetermined value, 4. said clutch means including pressure adjustment means carried by the shaft within said housing for selectively increasing the engagement pressure between the first and second friction disc means to predetermine the slippage point between said disc means, the pressure adjustment means including a threaded element axially movable on the threaded portion and axially spaced from said friction disc means, and resilient means coaxially mounted on the shaft between said friction disc means and said threaded element so that movement of said element toward said friction disc means increases the pressure between said means.

3. An adaptor for limiting torque applied to a bolt by a wrench, the adaptor comprising:

a. an elongate housing including bolt engagement means at one end for operatively turning the bolt, b. an elongate shaft disposed coaxially within the housing and including wrench engagement means at the end remote from said bolt engagement means, c. means mounting the shaft within the housing including:

1. journal bearing means between the shaft and the housing for relative rotation of said shaft and housing, 2. thrust bearing means between the shaft and the housing for transferring axial load from the shaft to the housing, and 3. clutch means between the shaft and the housing including first friction disc means keyed to the shaft and second friction disc means keyed to the housing, said first and second disc means being operatively pressure engageable to rotate the shaft and housing together when the torque applied to the bolt by the wrench, through the medium of the adaptor, is below a predetermined value, 4. said clutch means including pressure adjustment means carried by the shaft for selectively increasing the engagement pressure between the first and second friction disc means to predetermine the slippage point between said disc means, d. the shaft including an annular seating means and a threaded portion, e. said first and second friction disc means being operatively seated on said seating means said first friction disc means including a plurality of friction discs having an inner margin keyed to the shaft and said second friction disc means including a plurality of friction discs alternately disposed with said first friction disc means and having an outer margin keyed to the housing, f. the pressure adjustment means includes a threaded element movable on the shaft threaded portion and axially spaced from said friction discs, g. resilient means coaxially mounted on the shaft is disposed between said friction discs and said threaded element so that movement of said element toward said friction discs increases the pressure between said discs, h. the clutch means including spaced upper and lower friction discs and axially spaced index means, one of said index means being disposed to fixed axial relation to said upper disc and the other of said index means being disposed in fixed axial relation to said lower disc and in fixed axial relation to said housing, and i. the housing including a reference window adjacent said upper index means to measure relative movement of said upper index means to indicate a change in the axial spacing between said upper and lower friction discs.

4. An adaptor for limiting torque applied to a bolt by a wrench, the adaptor comprising:

a. an elongate housing having opposed ends, said housing including:

1. a bolt engagement socket at one end, 2. an opening at the other end, 3. an interior abutment disposed between said ends, 4. an exterior abutment disposed between said ends, and 5. an intermediate keyed portion, b. an elongate shaft having opposed ends, said shaft being disposed coaxially within said housing and including:

1. a keyed portion, 2. a threaded portion 3. a wrench engagement portion projecting outwardly from the housing opening, 4. a bearing shoulder, and
5. a seating shoulder, and c. means mounting the shaft within the housing including:

1. journal bearing means axially spaced on the shaft and extending radially between the shaft and the housing for relative rotation of said shaft and housing,
2. first thrust bearing means operatively disposed between the shaft bearing shoulder and the housing interior abutment for transferring axial load from the shaft to the housing, and second thrust bearing means operatively seated on the housing exterior abutment and extending beyond the socket end of the housing,
3. clutch means coaxially mounted on the shaft and including a disc assembly providing a plurality of first annular friction discs having an inner margin configurated to engage the keyed portion of the shaft for rotation with the shaft and a plurality of second annular friction discs having an outer margin configurated to engage the keyed portion of the housing for rotation with said housing, said disc assembly being operatively seated on the shaft seating shoulder and said first and second discs being operatively pressure engageable to rotate the shaft and housing together when the torque applied to the bolt by the wrench through the medium of the adaptor is below a predetermined value, and
4. said clutch means including a threadedly movable pressure adjustment element mounted to the threaded portion of the shaft, and spring means disposed axially between said movable element and the disc assembly for selectively increasing the engagement pressure between the friction discs to predetermine the slippage point between said discs.

5. An adaptor as defined in claim 4, in which:

d. the clutch means includes axially spaced upper and lower index means each disposed in fixed relation to one end of said disc assembly to indicate movement of said friction discs toward each other, and
e. the housing includes a reference window disposed adjacent said upper index means in fixed relation from said lower index means to measure relative movement of said index means to indicate a change in the collective thickness of said friction discs.

* * * * *